US009703240B2

(12) United States Patent
Kirikubo et al.

(10) Patent No.: US 9,703,240 B2
(45) Date of Patent: Jul. 11, 2017

(54) FUSER CONTROL DEVICE AND IMAGE FORMING APPARATUS

(71) Applicant: Konica Minolta, Inc., Chiyoda-ku, Tokyo (JP)

(72) Inventors: Seiichi Kirikubo, Toyohashi (JP); Mikiyuki Aoki, Toyohashi (JP); Akinori Kimata, Toyokawa (JP); Takeshi Tamada, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/227,369

(22) Filed: Aug. 3, 2016

(65) Prior Publication Data

US 2017/0038711 A1 Feb. 9, 2017

(30) Foreign Application Priority Data

Aug. 6, 2015 (JP) ..... 2015-155797

(51) Int. Cl.
*G03G 15/20* (2006.01)

(52) U.S. Cl.
CPC ..... *G03G 15/2039* (2013.01); *G03G 15/2078* (2013.01)

(58) Field of Classification Search
CPC ..... G03G 15/2039; G03G 15/2078
See application file for complete search history.

(56) References Cited

U.S. PATENT DOCUMENTS 7,277,651 B2 * 10/2007 Hanamoto ..... G03G 15/2039 399/69
2010/0316404 A1 * 12/2010 Fukuzawa ..... G03G 15/2039 399/69

FOREIGN PATENT DOCUMENTS

| | | | |
|---|---|---|---|
| JP | H09201043 | A | 7/1997 |
| JP | H09319411 | A | 12/1997 |
| JP | H10097155 | A | 4/1998 |
| JP | 2009069371 | A | 4/2009 |

* cited by examiner

*Primary Examiner* — Hoang Ngo
(74) *Attorney, Agent, or Firm* — Cantor Colburn LLP

(57) ABSTRACT

A fuser control device includes: a fusing portion having a heater; a chopper portion including a reactor, a free-wheeling element, and a switching element; and a processor portion being configured to implement a first current control during an implementation period, the implementation period including a first time interval and a second time interval, the implementation period being longer than a commercial power period, the first current control for transferring a control signal having a predetermined duty ratio to the switching element during the first time interval and transferring a control signal having a 100% duty ratio to the switching element during the second time interval.

14 Claims, 10 Drawing Sheets

FUSER CONTROL DEVICE AND IMAGE FORMING APPARATUS

This application claims priority under 35 U.S.C. §119 to Japanese Patent Application No. 2015-155797 filed on Aug. 6, 2015, the entire disclosure of which is incorporated herein by reference in its entirety.

BACKGROUND OF THE INVENTION

Field of the Invention

The present invention relates to: a fuser control device that delivers current to a heater housed in a fusing device with a predetermined duty ratio; and an image forming apparatus.

Description of the Related Art

The following description sets forth the inventor's knowledge of related art and problems therein and should not be construed as an admission of knowledge in the prior art.

Japanese Unexamined Patent Publication No. 2009-069371 describes such an image forming apparatus as described above. In this image forming apparatus, a rectifier circuit receives alternating current from a commercial power source and converts it to direct current. An inverter circuit receives direct current from the rectifier circuit, converts it to alternating current by switching (between on and off) a switching element at a duty ratio determined by a control signal from a processor portion, and delivers alternating current to a heater. In the manner described above, the image forming apparatus controls the current delivered to the heater.

Other image forming apparatuses each are allowed to control the current delivered to a heater by a well-known chopper circuit including a switching element, a free-wheeling element (diode), and a reactor. This chopper circuit operates in continuous current mode when switching the switching element at a high duty ratio (e.g., when the image forming apparatus performs printing). In continuous current mode, reverse current flows through the free-wheeling element, and the level of terminal noise grows accordingly. The temperature of the switching element is also raised by switching loss. During this conventional current control, bulk power often fails to be delivered to the heater, and the temperature of the fusing device thus can be controlled within only a limited range.

SUMMARY OF THE INVENTION

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

A first aspect of the present invention relates to a fuser control device including:

a fusing portion having a heater;

a chopper portion including a reactor, a free-wheeling element, and a switching element; and a processor portion being configured to implement a first current control during an implementation period, the implementation period including a first time interval and a second time interval, the implementation period being longer than a commercial power period, the first current control for transferring a control signal having a predetermined duty ratio to the switching element during the first time interval and transferring a control signal having a 100% duty ratio to the switching element during the second time interval, wherein:

the switching element is configured to deliver current to the heater while being driven at a switching frequency based on the control signal from the processor portion during the first time interval, the current having a switching period shorter than half the commercial power period, and to deliver current to the heater while not being driven during the second time interval; and the value of the predetermined duty ratio falls in a range causing no continuous current delivered to the heater.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying drawings, in which.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Figure 1:
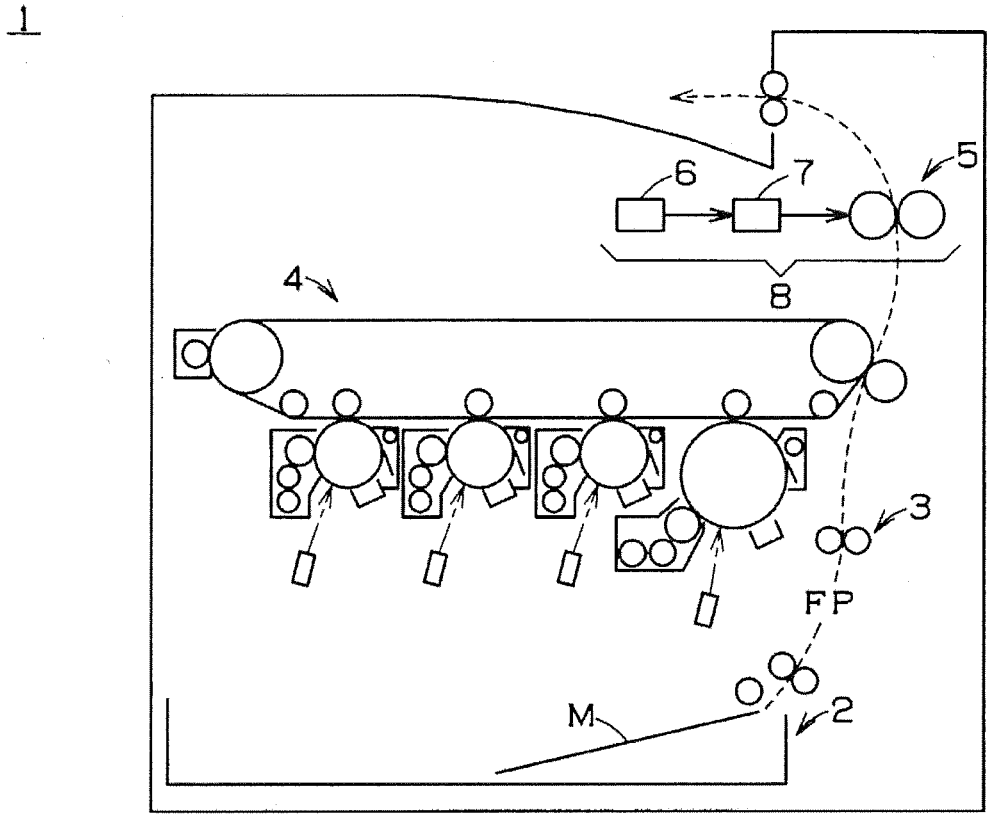
FIG. 1 is a view illustrating a comprehensive configuration of an image forming apparatus.

First Section: Comprehensive Configuration and Print Operation of the Image Forming Apparatus FIGS. 1 and 2 relate to an image forming apparatus 1 that is a copier, a printer, a facsimile, or a multifunctional machine having copier, printer, and facsimile functions, for example. The image forming apparatus 1 prints an image on a sheet-like print medium M (print paper, for example). The image forming apparatus 1 is essentially provided with a paper feeding portion 2, a pair of paper stop rollers 3, an image forming portion 4, a fusing portion 5, a controller portion 6, and a power supply portion 7. A fuser control device 8 is essentially comprised of the fusing portion 5, the controller portion 6, and the power supply portion 7. Hereinafter, operations to be performed by these portions when the image forming apparatus 1 performs printing will be described.

Blank print mediums M are loaded on the paper feeding portion 2. The paper feeding portion 2 transfers print mediums M one by one to a conveyor path F which is indicated by a dashed line in FIG. 1. The pair of resist rollers 3 is disposed along the conveyor path FP in the downstream of the paper feeding portion 2. The pair of resist rollers 3 briefly stops moving to stop a print medium M received from the paper feeding portion 2 then starts moving again to direct it to a second transfer area at a predetermined timing.

The image forming portion 4 forms toner images on an intermediate transfer belt by a well-known method such as a tandem electro-photographic print method. The intermediate transfer belt carries the toner images to the second transfer area.

While the print medium M arrives at the second transfer area from the pair of resist rollers 3, the toner images arrive at the second transfer area from the image forming portion 4. At the second transfer area, the toner images are transferred onto the print medium M from the intermediate transfer belt.

The fusing portion 5 is provided with a heat roller 51 and a pressure roller 53 that form a nip area by contact with each other. The heat roller 51 is a tubular roller having a heater 52 in its hollow core. The heater 52 is a halogen heater, for example, and is turned on with current supplied from the power supply portion 7. The pressure roller 53 rotates under the control of the controller portion 6. The heat roller 51 rotates as driven by the pressure roller 53. At the nip area, the heat roller 51 and the pressure roller 53 both apply pressure to the print medium M, and the heat roller 51 further applies heat to the print medium M. The toner images are fixed on the print medium M accordingly. The heat roller 51 and the pressure roller 53 then transfer the print medium M to a paper receiving tray.

The fusing portion 5 is further provided with a first temperature detecting portion 54 such as a thermistor. The first temperature detecting portion 54 detects the temperature of the heat roller 51 (i.e., fuser temperature) and transfers the detection result to the controller portion 6.

The controller portion 6 is provided with a CPU that executes programs stored on a ROM using a RAM as a work area. The controller portion 6 performs various control operations; in this embodiment, however, it is of particular importance that the controller portion 6 controls the current delivered to the heater 52. Specifically, the controller portion 6 determines a duty ratio for a switching element 831 to be later described, by pulse width modulation (PWM) control or pulse frequency modulation (PFM) control, such that the detection result obtained by the first temperature detecting portion 54 reaches a target temperature. The controller portion 6 determines a duty ratio using a well-known algorithm such as a PID or PI control algorithm. In this embodiment, the current delivered to the heater 52 is controlled by a first current control and a second current control, and the controller portion 6 switches between the first and second current control depending on a predetermined condition.

Figure 2:
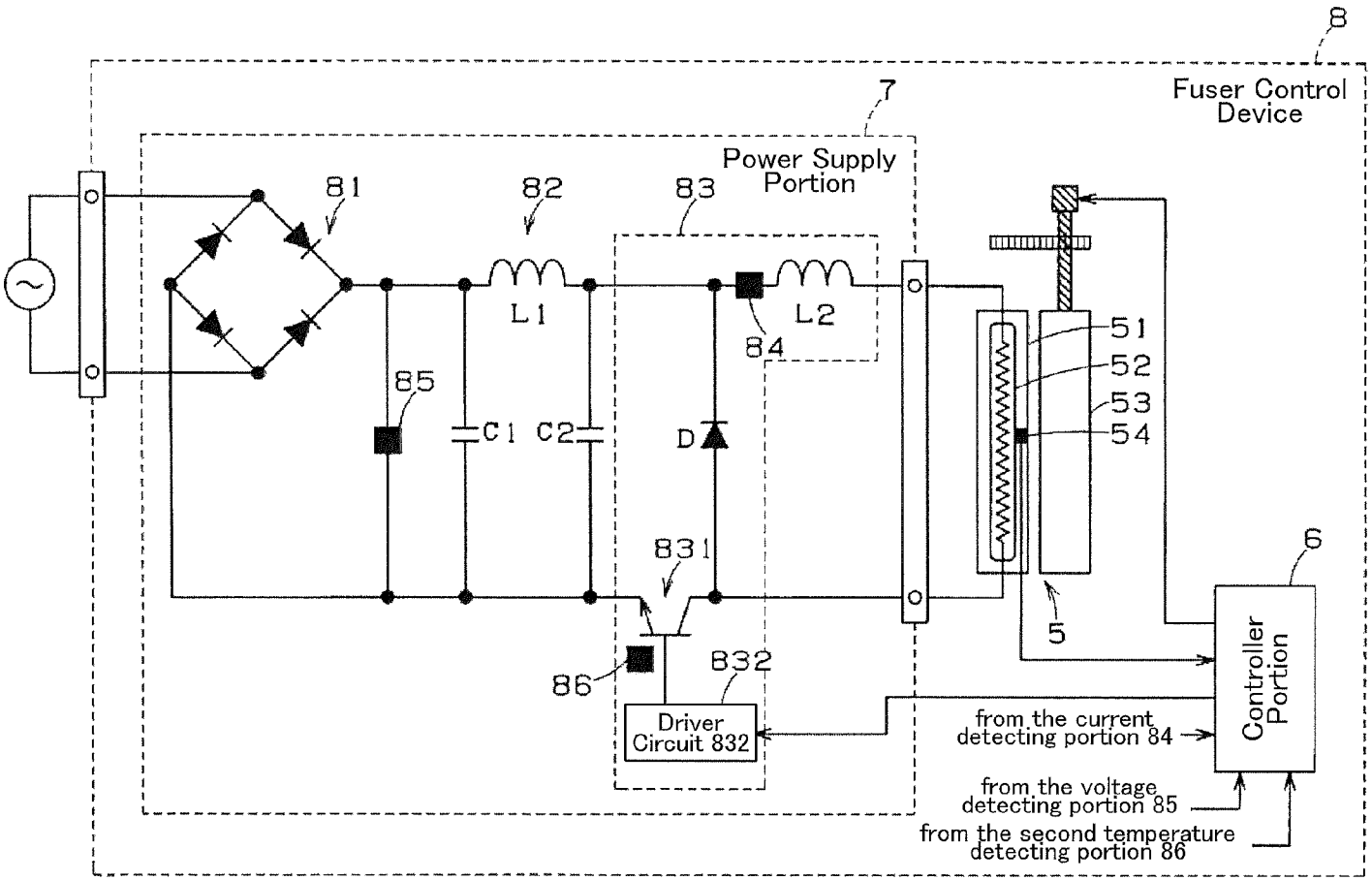
FIG. 2 is a view illustrating a configuration of a fuser control device.

As referred to FIG. 2, the power supply portion 7 is essentially provided with a rectifier circuit 81, a noise filter 82, and a chopper circuit 83. The power supply portion 7 is further provided with a current detecting portion 84, a voltage detecting portion 85, and a second temperature detecting portion 86.

The rectifier circuit 81 is connected to a commercial power source. In Japan, for example, the commercial power frequency is 50 or 60 Hz.

The noise filter 82 is a pi-type filter, for example, and is connected in series with an output of the rectifier circuit 81. Specifically, the noise filter 82 is provided with a coil L1 and capacitors C1 and C2. The coil L1 is connected in series with the heater 52, and the capacitors C1 and C2 are connected in parallel with the heater 52.

The chopper circuit 83 is a step-down chopper circuit, for example, and is connected in series with an output of the noise filter 82. The chopper circuit 83 is provided with a coil (reactor) L2, a free-wheeling element D, a switching element 831, and a driver circuit 832.

The coil L2 is connected in series with the coil L1 and the heater 52, being arranged at a position between the coil L1 and the heater 52.

The free-wheeling element D is a diode, for example, and is connected in parallel with the heater 52, being arranged at a position between the coil L2 and the noise filter 82. Specifically, the free-wheeling element D is arranged such that its cathode is electrically connected to a position between the coils L1 and L2 and its anode is electrically connected to a position between the heater 52 and a collector of the switching element 831.

The switching element 831 is an insulated gate bipolar transistor (IGBT) or a metal-oxide semiconductor field-effect transistor (MOS-FET), for example, and is connected in series with the heater 52, being arranged at a position between the free-wheeling element D and the noise filter 82. Specifically, the switching element 831 is arranged such that a collector of the switching element 831 is electrically connected to the heater 52 and an emitter of the switching element 831 is electrically connected to an output of the rectifier circuit 81. The driver circuit 832 is connected to a gate of the switching element 831; the driver circuit 832 determines a duty ratio and a drive frequency for the switching element 831 under the control of the controller portion 6. The heater 52 is arranged at a position between output terminals of the chopper circuit 83 described above.

The current detecting portion 84 detects the value of the current delivered to the reactor L2 (hereinafter referred to as "reactor current") and transfers a periodic signal indicating the detected current value to the controller portion 6 (specifically, at a regular interval much shorter than a first time interval D1 to be later described).

The voltage detecting portion 85 detects the value of the voltage across output terminals of the rectifier circuit 81 (hereinafter referred to as "voltage across terminals"), and outputs a periodic signal indicating the detected voltage value to the controller portion 6 (specifically, at a regular interval much shorter than the first time interval D1).

The second temperature detecting portion 86 detects the temperature of the switching element 831 (hereinafter referred to as "element temperature") and outputs a periodic signal indicating the detected temperature to the controller portion 6 (specifically, at a regular interval much shorter than the first time interval D1).

Third Section: Second Current Control (a Commonly Implemented Control for Controlling the Current Delivered to a Heater)

In this section, a commonly implemented control for controlling the current delivered to the heater 52 will be described with reference to FIGS. 1 to 6.

Figure 3:
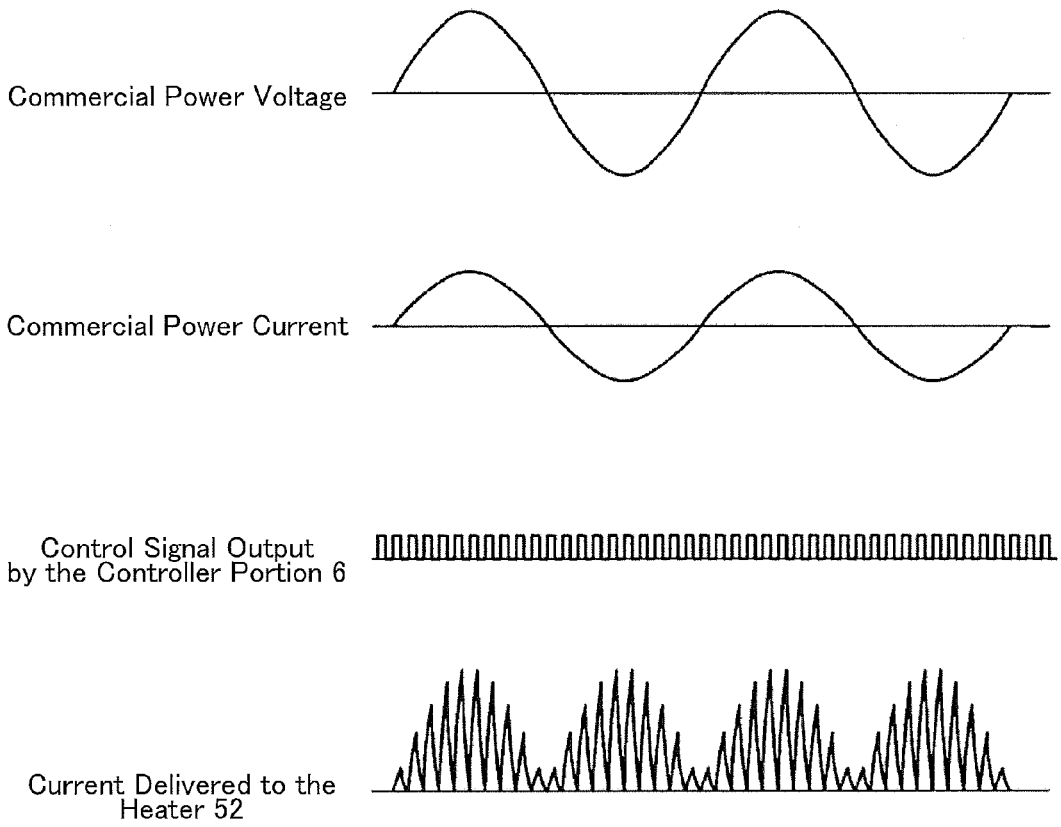
FIG. 3 is a schematic view illustrating time waveforms at substantial portions of the fuser control device.

The rectifier circuit 81 receives alternating current (refer to the second waveform from the top in FIG. 3) from a commercial power source. The top waveform in FIG. 3 represents a commercial power voltage. The rectifier circuit 81 obtains direct current by performing full-wave rectification on the input current. The noise filter 82 removes noise from the output current of the rectifier circuit 81 and prevents high-frequency components of the pulsed current from leaking to the commercial power source from the switching element 831.

The controller portion 6 inputs to the driver circuit 832 control signals (refer to the third waveform from the top in FIG. 3) that essentially define a time interval (i.e., a pulse period and a duty ratio) for which to turn on the heater 52. The driver circuit 832 converts the input control signals to drive signals (refer to the bottom waveform in FIG. 3) for switching the switching element 831 between on and off, and inputs the drive signals to a gate of the switching element 831. In this embodiment, the switching element 831 is driven at a switching frequency of over the upper limit of the audible frequency range (a frequency of over 20 kHz), which is much higher than a commercial power frequency.

Figure 4:
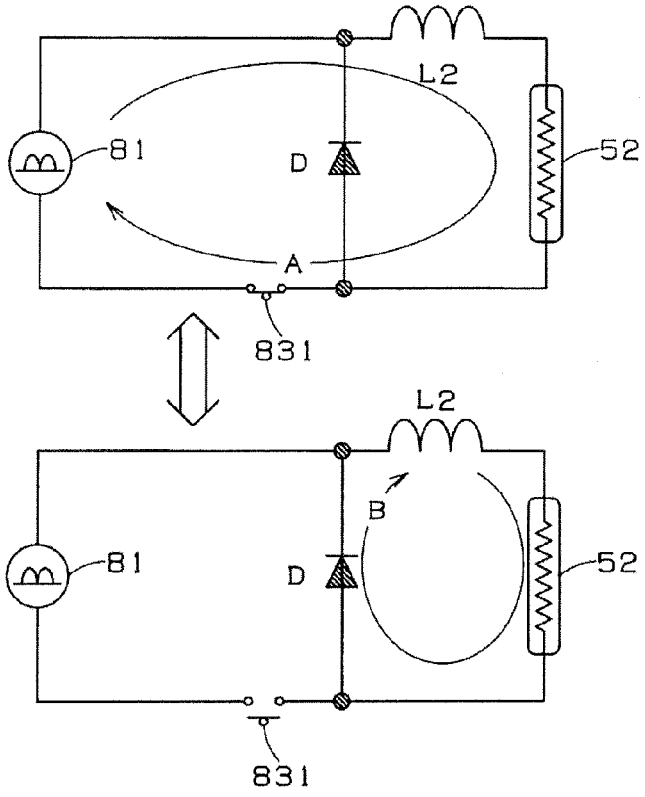
FIG. 4 is a view indicating heater current during an on-period of the switching element of FIG. 2 in the upper circuit diagram and heater current during an off-period of the switching element of FIG. 2 in the lower circuit diagram.

When the switching element 831 is turned on, the direct current obtained by the rectifier circuit 81 is delivered to the coil L2 and the heater 52 by way of the switching element 831 as indicated by an arrow A in the upper circuit diagram in FIG. 4. Meanwhile, the coil L2 accumulates a part of the direct current flowing through the coil L2 itself, as magnetic energy.

When the switching element 831 is turned off, the magnetic energy, which has been accumulated in the coil L2 during an on-period of the switching element 831, is released as an electric current and delivered to the heater 52. This current then returns to the coil L2 through the free-wheeling element D serving as a regenerative diode.

Figure 5:
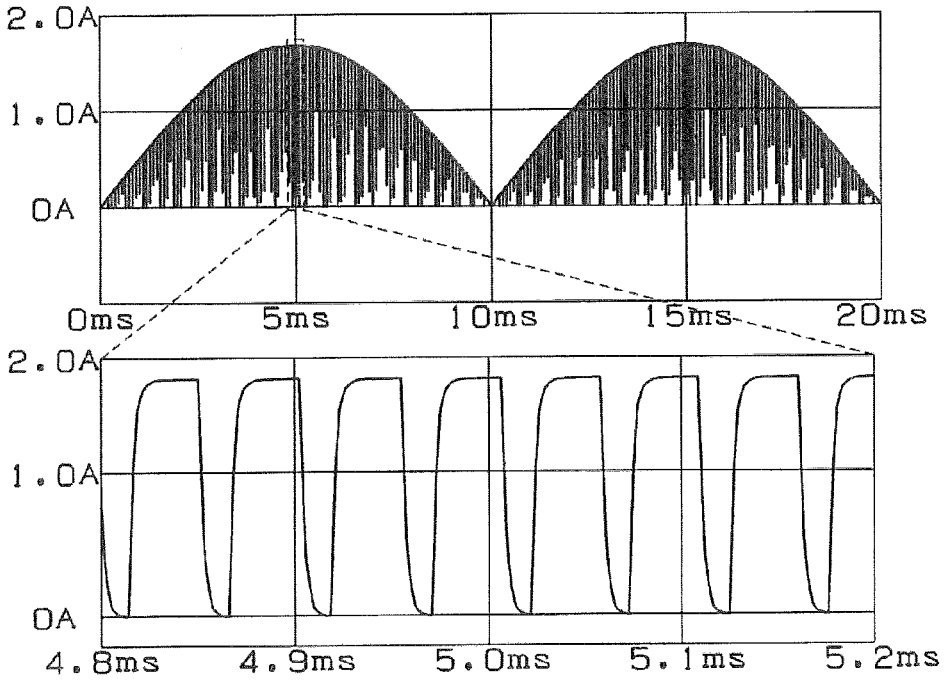
FIG. 5 is a view illustrating a time waveform of the current input to the heater of FIG. 2.

The current, which is input to the heater 52 by the power supply portion 7 as described above, forms a curve that is close to a sine wave as indicated in FIG. 5. This maintains a high power factor of the power supply portion 7 and causes few harmonic components in the input current.

Controlling current with a high and low duty ratio allows the heater 52 to consume power in an efficient manner, causing few temperature ripples. The fusing portion 5 evenly fuses full-color toner images accordingly.

Figure 6:
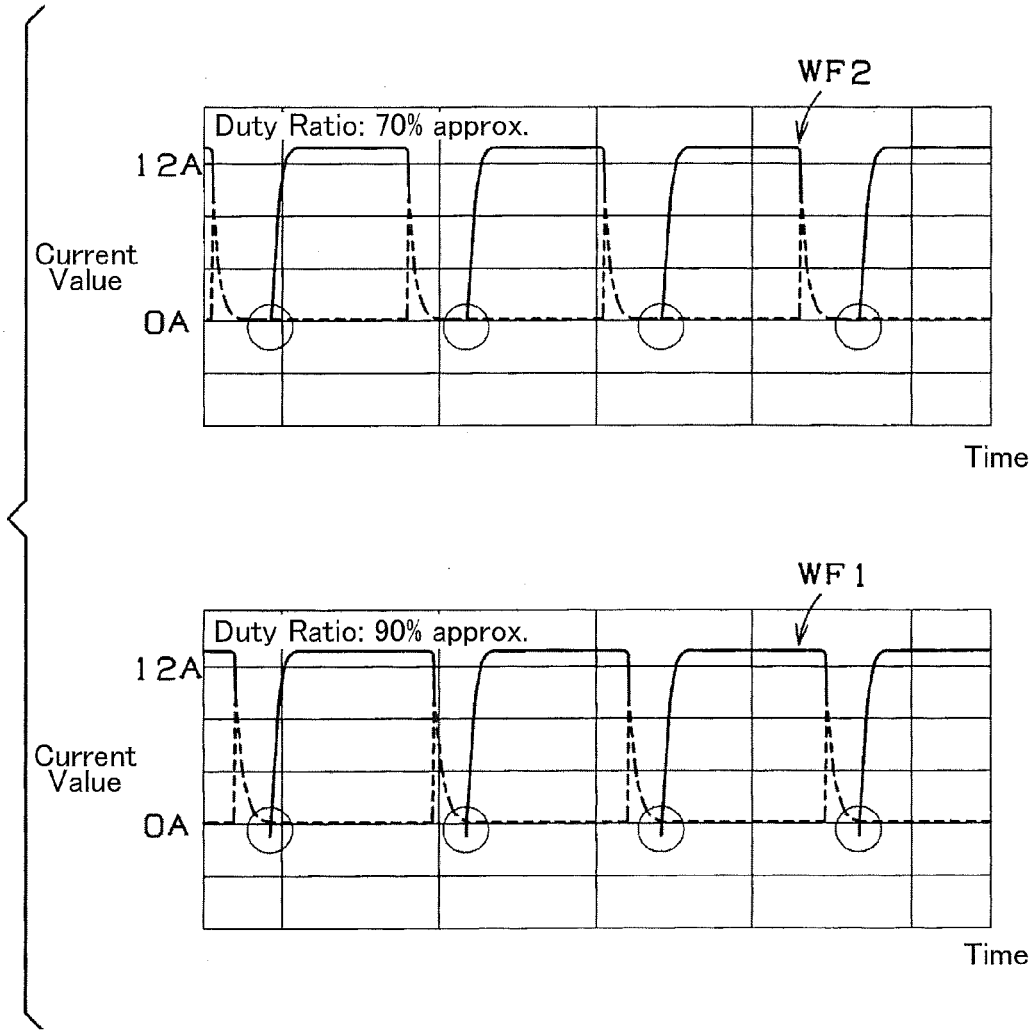
FIG. 6 is a view indicating heater current with a low duty ratio in the upper chart and heater current with a high duty ratio in the lower chart.

The upper chart in FIG. 6 indicates a time waveform WF2 of the current delivered to the coil L2 and the heater 52, which is resultant current of the current input by the rectifier circuit 81 (indicated by a solid line) and the circulating current flowing through the free-wheeling element D (indicated by a dashed line) when the switching element 831 is turned off. As referred to the current waveform WF2 in the upper chart in FIG. 6, the current having a low duty ratio (duty ratio is the ratio of a pulse width to a predetermined pulse period) has a sufficient time to fall after turn-off of the switching element 831. In this embodiment, when a commercial power frequency is 50 or 60 Hz, duty ratios in the range of 80% and under, for example, are defined as low duty ratios. With a low duty ratio, the current falls to 0 amperes at a start of every pulse period, which is indicated by a circle in the upper chart in FIG. 6. In other words, discontinuous current is delivered to the coil L2, and no reverse current flows through the free-wheeling element D (i.e., there is no reverse current noise) accordingly. In this embodiment, the second current control is to control the current delivered to the heater 52 by transferring a control signal having a low duty ratio to the switching element 831.

During the second current control, the switching element 831 is turned between on and off at a switching frequency determined by a periodic control signal. When the coil L2 oscillates at a switching frequency of the audible frequency range, i.e., 20 kHz or less, however, noise can be heard from the image forming apparatus 1, which is undesirable. To prevent this, the switching frequency is preferred to be over the upper limit of the audible frequency range.

Fourth Section: Detailed Description of Technical Problems

The lower chart in FIG. 6 indicates a waveform WF1 of the current delivered to the heater 52 with a high duty ratio (duty ratio is the ratio of a pulse width to a predetermined pulse period) during the second current control. In this embodiment, when a commercial power frequency is 50 or 60 Hz, duty ratios in the range of over 80% and under 100%, for example, are defined as high duty ratios. Hereinafter, an 80% duty ratio, which is a boundary between the high and low ranges, will be referred to as a "predetermined duty ratio". With a high duty ratio, continuous current is delivered to the heater 52. In continuous current mode, the current delivered to the heater 52 is never zero practically. In continuous current mode, as referred to the current waveform WF1, the rectifier circuit 81 outputs a pulse of current before a previous pulse of current falls to 0 amperes. In other words, the switching element 831 is turned on while circulating current flows into the heater 52. The current value is not 0 at a start of every pulse which is indicated by a circle in the upper chart in FIG. 6. This causes reverse current flowing through the free-wheeling element D and reverse current noise accordingly, which is undesirable. Furthermore, the switching element 831 is turned on while current flows through the free-wheeling element D. This causes switching loss and a rise of the temperature of the switching element 831 accordingly, which is also undesirable. There are various problems as described above when the switching element 831 is driven at a high duty ratio (to deliver bulk power to the heater 52). In other words, the fuser temperature cannot be controlled within a sufficiently wide range only by the second current control. To overcome these problems, in this embodiment, the current input to the switching element 831 is controlled by the first current control and the second current control, and the controller portion 6 switches between the first and second current control as necessary.

Fifth Section: Brief Description of the First Current Control

Figure 7:
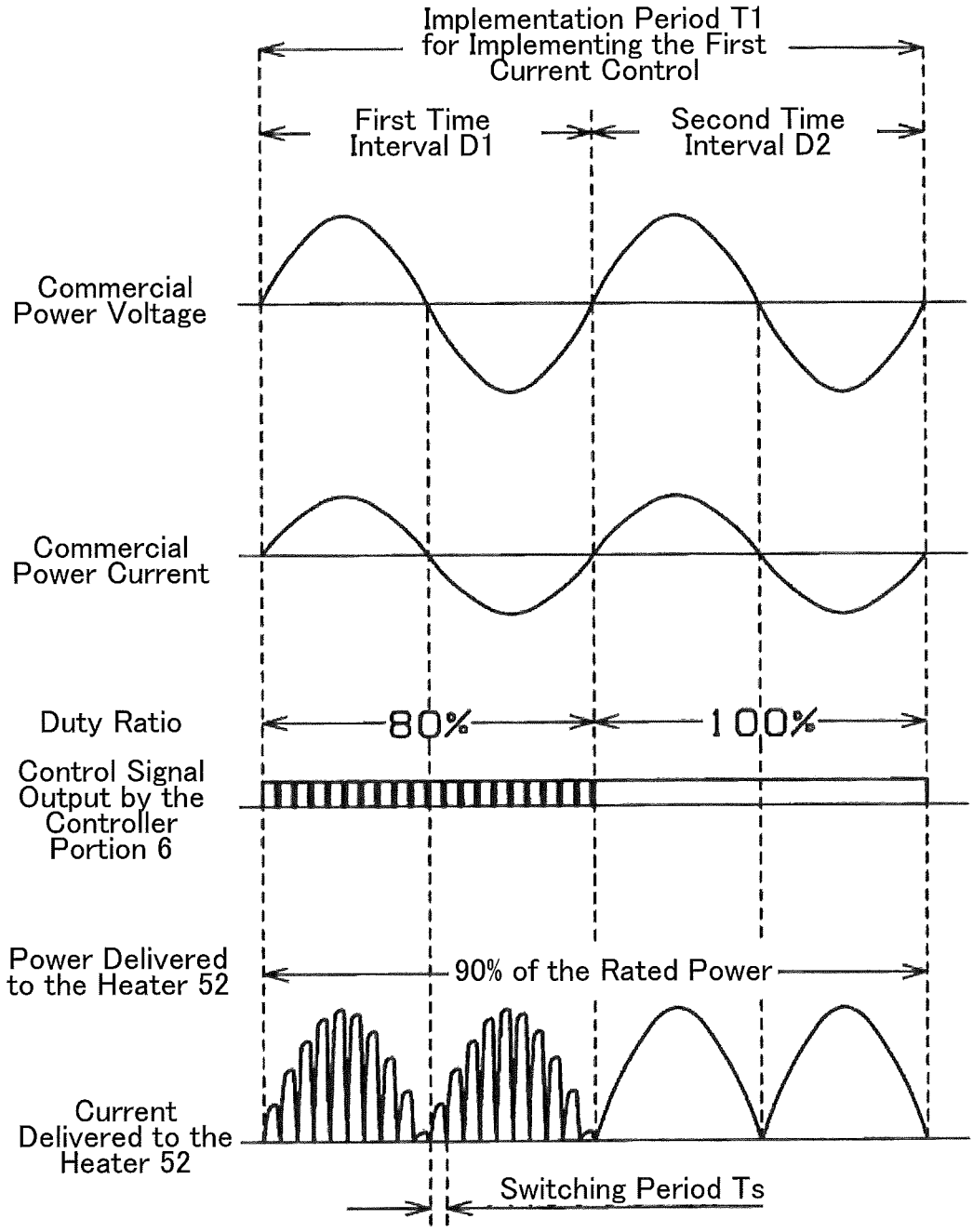
FIG. 7 is a schematic view illustrating time waveforms at substantial portions of the fuser control device during the first current control.

Hereinafter, the first current control will be described in details with reference to FIG. 7. During this control, bulk power as much as 90% of the rated power is delivered to the heater 52. During the second current control, with so much power, the switching element 831 will be driven at a high duty ratio (an 80 to 99 duty ratio), and continuous current will be delivered to the heater 52.

To prevent continuous current, the controller portion 6 switches between the first and second current control at a regular interval. An implementation period T1 for implementing the first current control is equal to a multiple of twice a commercial power period and is equal to twice or more a commercial power period. Each implementation period T1 includes at least one first time interval D1 and at least one second time interval D2. The first time interval D1 and the second time interval D2 each are equal to one commercial power period. As referred to FIG. 7, the implementation period T1 is equal to twice the commercial power period (i.e., the lower limit), for example. The upper limit of the implementation period T1 is equal to twice the value of a thermal time constant of the heat roller 51 that is a body heated by the heater 52. Here, the thermal time constant is the time required to change 50% of the total difference between an initial temperature and a final temperature.

During the first time interval D1, the controller portion 6 generates and outputs a control signal having a low duty ratio (i.e., an 80% duty ratio) that causes discontinuous heater current. This means, the current delivered to the heater 52 constitutes 80% of the rated power. During the second time interval D2, the controller portion 6 generates and outputs a control signal having a 100% duty ratio. This means, the current delivered to the heater 52 constitutes 100% of the rated power and forms a sine wave. Since the switching element 831 is not driven during this time interval, no continuous current in principle is delivered to the heater 52.

The average of the duty ratios in the implementation period T1 is 90%. This means, in the implementation period T1, the current delivered to the heater 52 constitutes 90% of the rated power. In the manner described above, by the first current control, bulk power is delivered to the heater 52 without causing continuous current, and the fuser temperature is successfully raised.

Sixth Section: Switch Between the First and Second Current Control

Figure 8:
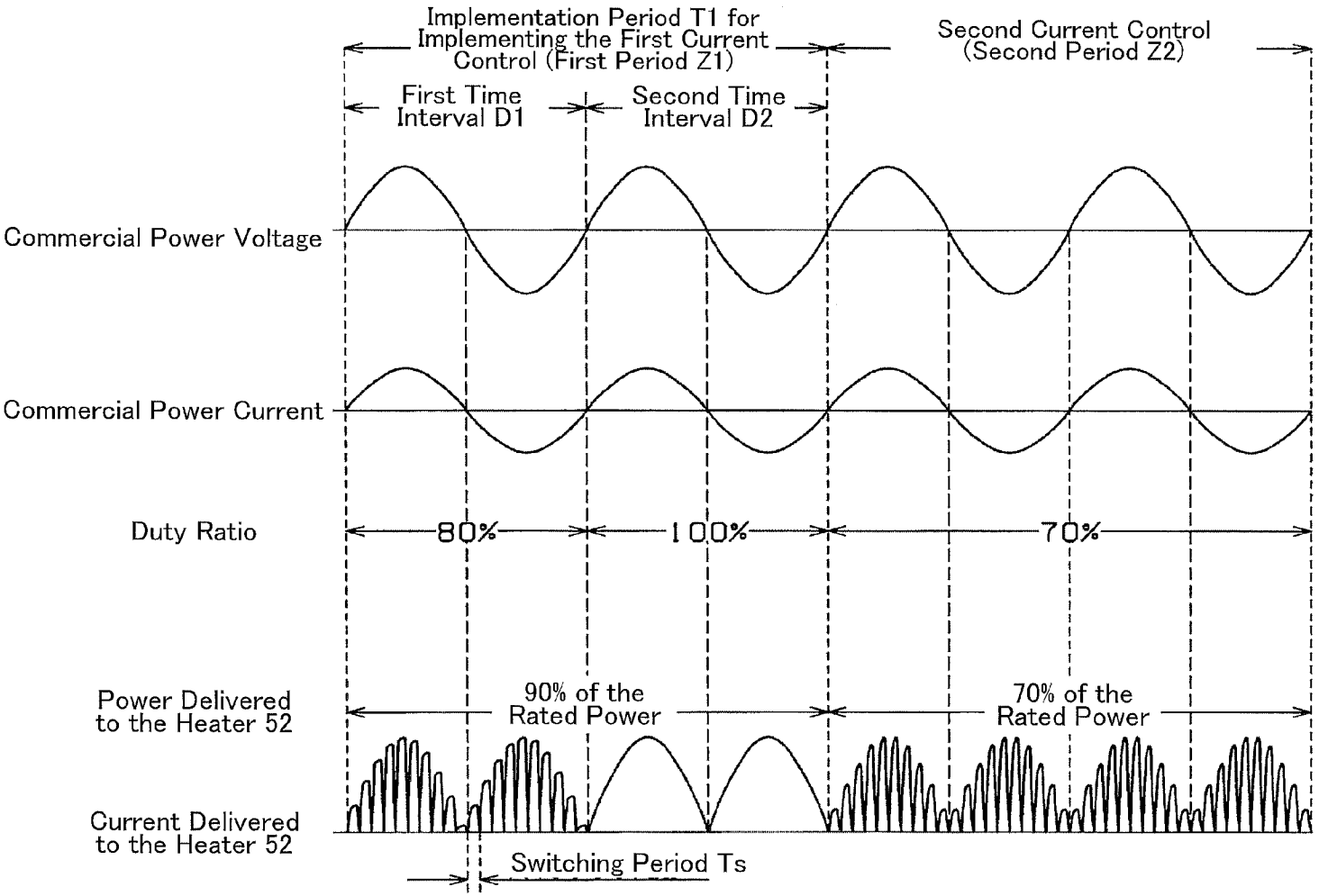
FIG. 8 is a schematic view illustrating examples of time waveforms at substantial portions of the fuser control device when the controller portion switches from the first current control to the second current control.

In this embodiment, the controller portion 6 switches between the first and second current control as necessary. Specifically, the first current control is implemented if a predetermined variable is greater than a threshold for judging whether or not continuous current is delivered to the heater 52, and the second current control is implemented if it is not. To control the fuser temperature, as referred to FIG. 8, 90% of the rated power is delivered to the heater 52 during a first period Z1, 70% of the rated power is then delivered to the heater 52 during a second period Z2.

As described above in Fourth Section, there are various problems when the switching element 831 is driven at a high duty ratio to deliver 90% of the rated power. To overcome these problems, the controller portion 6 implements the first current control during the first period Z1 in this embodiment. Specifically, by implementing the first current control, the controller portion 6 transfers a control signal having an 80% duty ratio to the switching element 831 during the first time interval D1 and transfers a control signal having a 100% duty ratio to the switching element 831 during the second time interval D2.

In contrast, no continuous current is delivered to the heater 52 when the switching element 831 is driven at a low duty ratio to deliver 70% of the rated power. The controller portion 6 thus implements the second current control during the second period Z2. That is, the controller portion 6 transfers a control signal having a 70% duty ratio to the switching element 831 during the entire second period Z2.

To perform switching control as described above, the controller portion 6 judges whether or not continuous current is delivered to the heater 52 by judging whether or not a predetermined variable is greater than a predetermined threshold. If it is greater than a predetermined threshold, the controller portion 6 implements the first current control; if it is not, the controller portion 6 implements the second current control.

Figure 9:
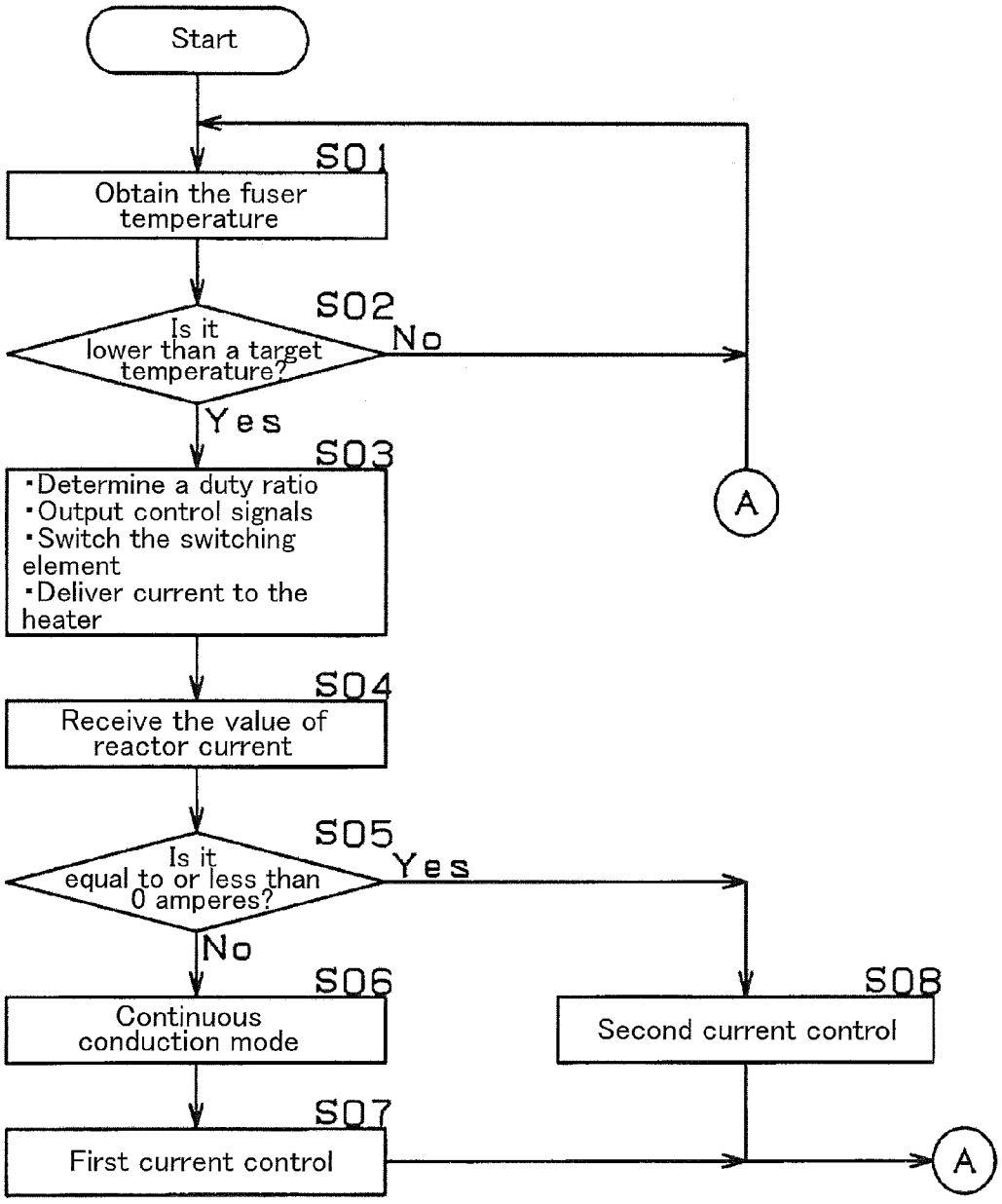
FIG. 9 is a flowchart representing a first example of a control switch operation to be performed by the controller portion of FIG. 2.

Hereinafter, a first example of switching control will be described with reference to FIG. 9.

The controller portion 6 obtains the fuser temperature from the start to the end of printing (Step S01, FIG. 9) and judges whether or not it is lower than a target temperature (Step S02). If it is No, the flowchart returns to Step S01. If it is Yes, the controller portion 6 performs the following operations (Step S03) to raise the fuser temperature to the target temperature: determining a duty ratio with a PID control algorithm, for example, by pulse width modulation (PWM) control, for example; and switching the switching element 831 at the determined duty ratio by transferring a control signal having the determined duty ratio to the driver circuit 832. Current is thus delivered to the heater 52 with the determined duty ratio.

Meanwhile, the current detecting portion 84 transfers the value of reactor current to the controller portion 6 on a periodic basis. After Step S03, the controller portion 6 obtains the value of reactor current as an example of a variable (Step S04) and judges whether or not the obtained value of reactor current is equal to or less than 0 amperes (Step S05). If it is Yes, the flowchart returns to Step S01 because there is no continuous heater current. This means, the controller portion 6 substantially implemented the second current control in Step S03.

If it is No in Step S05, the controller portion 6 judges that there is continuous heater current (Step S06) and implements the first current control (Step S07). The flowchart then returns to Step S01.

The controller portion 6 implements the first current control with reference to a table T1 stored in the controller portion 6 itself. The table T1 essentially contains the following information: duty ratios from which to select one in Step S03, which are over a predetermined duty ratio; the total number of the first time intervals D1 and the second time intervals D2 constituting one implementation period T1; the number of the first time intervals D1; the number of the second time intervals D2; and duty ratios for the first time interval D1. Here, the table T1 does not need to contain duty ratios for the second time interval D2 since it should be always 100% during this time interval.

TABLE T1

| The duty ratio determined in Step S03 [%] | The total number of the first and second time intervals D1 and D2 | The number of the first time interval D1 | Duty ratio for the first time interval D1 [%] | The number of the second time time interval D2 |
|---|---|---|---|---|
| 81 | 2 | 1 | 62 | 1 |
| 82 | 2 | 1 | 64 | 1 |
| 83 | 2 | 1 | 66 | 1 |
| 84 | 2 | 1 | 68 | 1 |
| 85 | 2 | 1 | 70 | 1 |
| 86 | 2 | 1 | 72 | 1 |
| 87 | 2 | 1 | 74 | 1 |
| 88 | 2 | 1 | 76 | 1 |
| 89 | 2 | 1 | 78 | 1 |
| 90 | 2 | 1 | 80 | 1 |
| 91 | 3 | 1 | 73 | 2 |
| 92 | 3 | 1 | 76 | 2 |
| 93 | 3 | 1 | 79 | 2 |
| 94 | 4 | 1 | 76 | 3 |
| 95 | 4 | 1 | 80 | 3 |
| 96 | 5 | 1 | 80 | 4 |
| 97 | 7 | 1 | 79 | 6 |
| 98 | 10 | 1 | 80 | 9 |
| 99 | 20 | 1 | 80 | 19 |

With reference to the duty ratio determined in Step S03, the controller portion 6 retrieves, in S06, a combination of the following information: the total number of the first time intervals D1 and the second time intervals D2; the number of the first time intervals D1; a duty ratio for the first time interval D1; and the number of the second time intervals D2. Subsequently, the controller portion 6 transfers a control signal having the retrieved duty ratio to the driver circuit 832 during the first time interval D1 and transfers a control signal having a 100% duty ratio to the driver circuit 832 during the second time interval D2. Specifically, when the duty ratio determined in Step S03 is 81%, the controller portion 6 retrieves the value of 2 as the total number of the first time intervals D1 and the second time intervals D2, the value of 1 as the number of the first time intervals D1, the value of 62% as a duty ratio for the first time interval D1, and the value of 1 as the number of the second time intervals D2. Meanwhile, the controller portion 6 obtains the value of the voltage across terminals from the voltage detecting portion 85 on a periodic basis, while waiting for the value of 0 volts. The first and second receipt of the value of 0 volts define the first time interval D1. During this first time interval D1, the controller portion 6 transfers a control signal having a 62% duty ratio to the driver circuit 832. The second and fourth receipt of the value of 0 volts define the second time interval D2. During this second time interval D2, the controller portion 6 transfers a control signal having a 100% duty ratio to the driver circuit 832. These processes constitute one implementation period T1 for implementing the first current control.

Seventh Section: Operation and Effect of the Fuser Control Device

According to the fuser control device 8 as described in the above sections, if the duty ratio determined in Step S03 causes continuous heater current, the first current control is implemented in Step S07. During the first current control, the switching element 831 is driven at a duty ratio causing no continuous heater current and at a 100% duty ratio. Continuous current is thus not delivered during the first current control. A duty ratio causing no continuous heater current should be relatively low. During the implementation period T1 for implementing the first current control, the switching element 831 is driven at a high duty ratio that is a combination of such a relatively low duty ratio and a 100% duty ratio. Thus, the temperature of the fusing portion 5 is able to be controlled within a wide range from a relatively low temperature to a high temperature.

During the first current control, the switching element 831 is driven at a duty ratio that is different from the duty ratio determined in Step S03, and the fuser temperature often fails to reach the target temperature. To overcome this problem, the fuser control device 8 implements the first current control and the second current control. If it is judged that continuous current is not delivered with reference to the value of reactor current (an example of a variable), the second current control is implemented. In the manner described above, the fuser temperature can successfully reach the target temperature.

Eighth Section: First Variation

Figure 10:
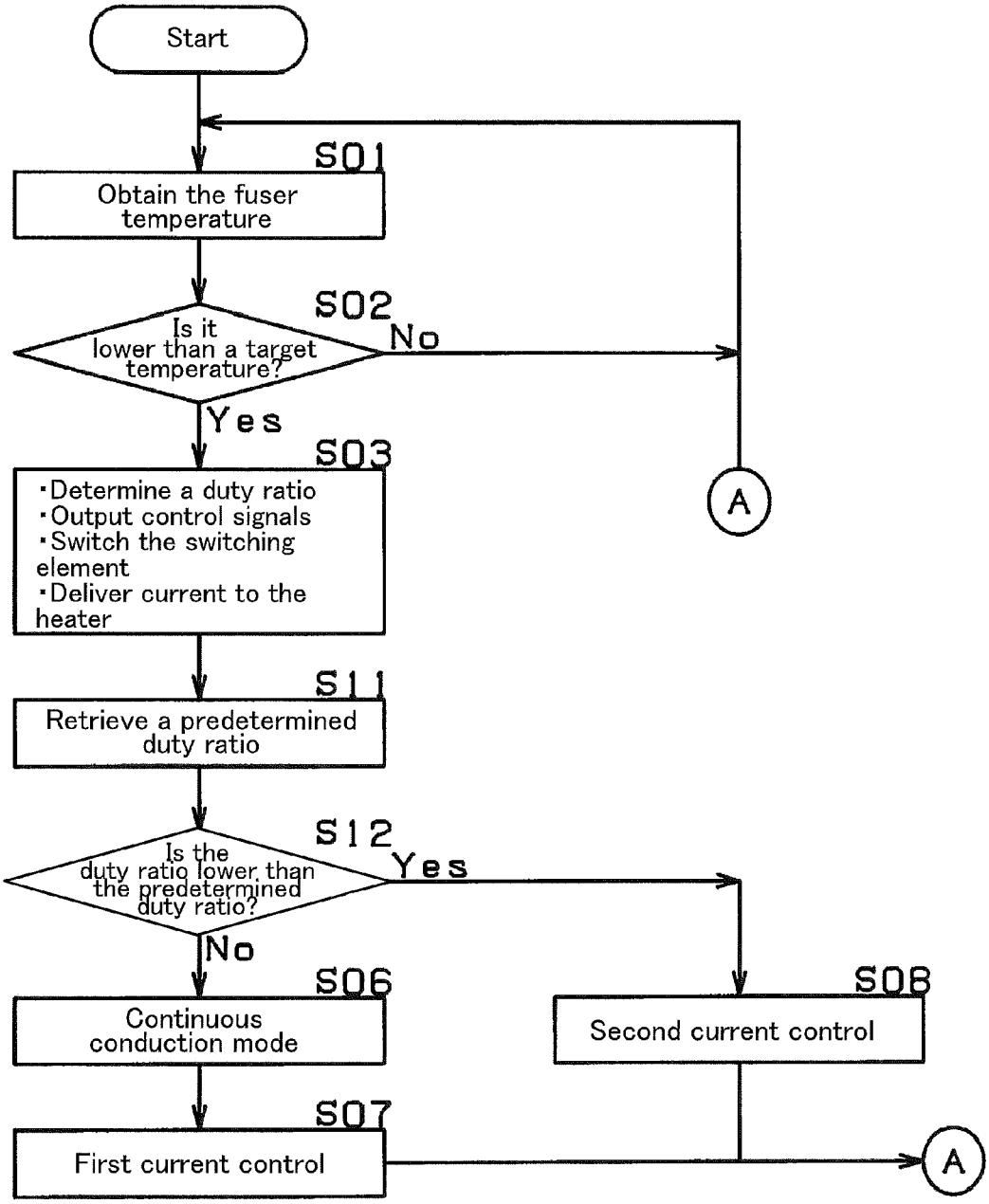
FIG. 10 is a flowchart representing a second example (a first variation) of a control switch operation to be performed by the controller portion of FIG. 2.

In the above-described embodiment, it is judged whether or not there is continuous heater current with reference to the value of reactor current. However, once specifications of the fuser control device 8 are determined, duty ratios causing no continuous heater current can be derived from the results of experiments. In a first variation, the controller portion 6 accordingly stores by default a threshold of duty ratio (i.e., a predetermined duty ratio) for judging whether or not there is continuous heater current. As referred to FIG. 10, the controller portion 6 retrieves the predetermined duty ratio (Step S11) and judges whether or not the duty ratio determined in Step S03 (an example of a variable) is equal to or lower than the threshold (Step S12). If it is No, the controller portion 6 then judges that there is continuous heater current (Step S06) and implements the first current control (Step S07). If it is Yes in S12, the controller portion 6 implements the second current control (Step S08).

As for the rated voltage of the heater 52, it is set to the value of a commercial power voltage that is used in a ship-to location (i.e., a ship-to country) of the image forming apparatus 1. For example, the rated voltage is set to 100 volts for Japan, and is set to 120 volts for North America. Meanwhile, the rated power is set to the same value for both Japan and North America. Since the rated voltages are set to values that are approximate to each other for these countries, the second current control does not need to be configured differently for these countries. For other countries, the rated voltage may be set to a value much lower than that for Japan. To deliver sufficient power to the heater 52 in such countries, a duty ratio higher than that for Japan needs to be used during the second current control. The controller portion 6 is thus preferred to store a different value range depending on the commercial power voltage to be used.

Ninth Section: Second Variation

Figure 11:
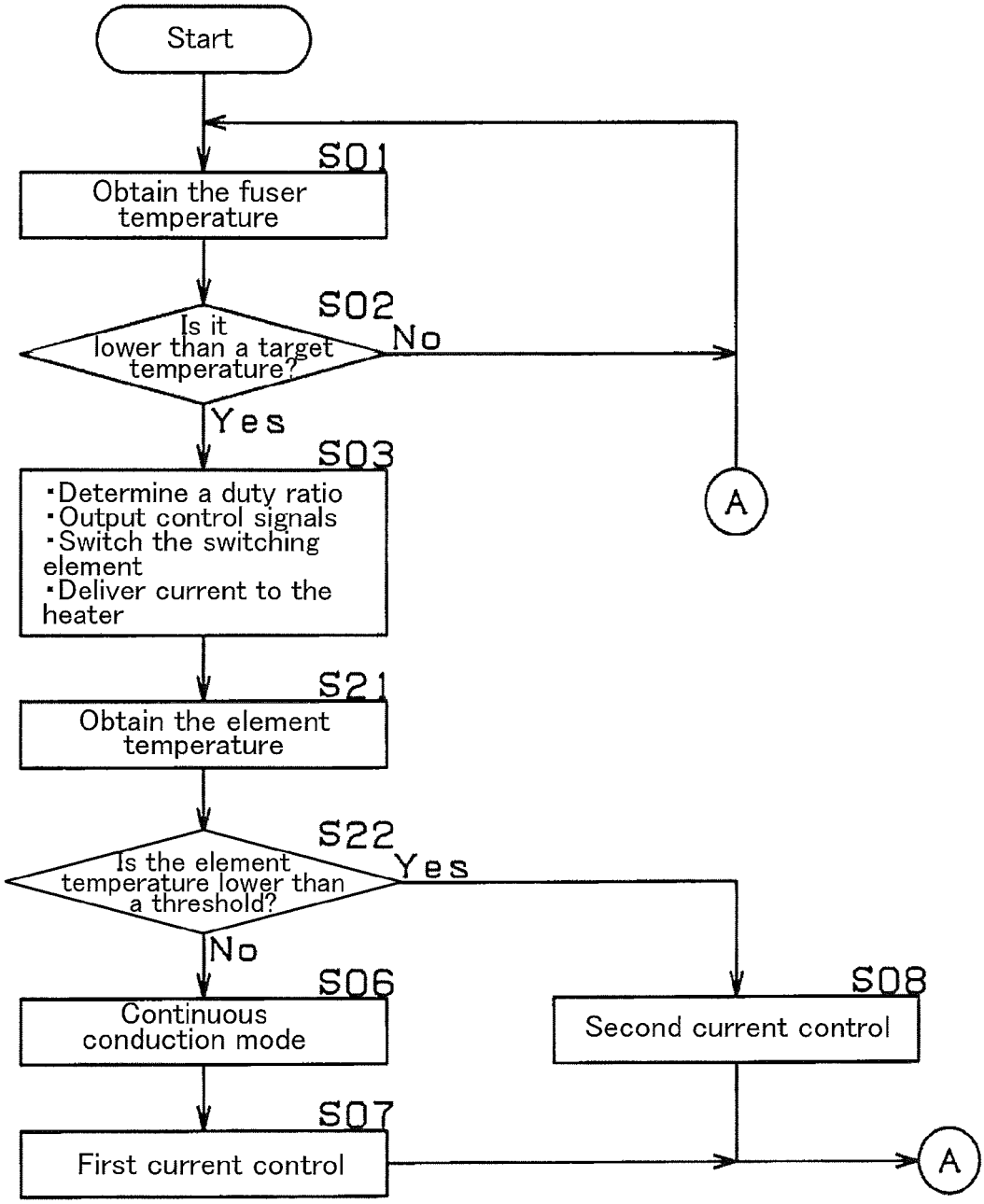
FIG. 11 is a flowchart representing a third example (a second variation) of a control switch operation to be performed by the controller portion of FIG. 2.

In the above-described embodiment, it is judged whether or not there is continuous heater current with reference to the value of reactor current. Continuous heater current causes a rise of the element temperature as described above. However, once specifications of the fuser control device 8 are determined, element temperatures causing no continuous heater current can be derived from the results of experiments. In a second variation, the controller portion 6 accordingly stores by default a threshold of element temperature for judging whether or not there is continuous heater current. As referred to FIG. 11, after determining a duty ratio in Step S03, the controller portion 6 obtains the element temperature as another example of a variable from the second temperature detecting portion 86 (Step S21) and judges whether or not the obtained element temperature is equal to or lower than the threshold (Step S22). If it is No, the controller portion 6 performs Steps S06 and S07; if it is Yes, the controller portion 6 performs Step S08.

Tenth Section: Supplemental Description

In the above-described embodiment and variations, the second current control is implemented when the image forming apparatus 1 performs printing. The present invention, however, is not limited thereto, and the second current control may be implemented when the image forming apparatus 1 performs warm-up.

INDUSTRIAL APPLICABILITY

A fuser control device and an image forming apparatus according to the above-described embodiment and variations of the present invention are preferred to be used in a copier, a printer, a facsimile, and a multifunctional machine having copier, printer, and facsimile functions.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to". In this disclosure and during the prosecution of this application, means-plus-function or step-plus-function limitations will only be employed where for a specific claim limitation all of the following conditions are present In that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example", and "NB" which means "note well".

What is claimed is:

1. A fuser control device comprising:

a fusing portion having a heater;

a chopper portion including a reactor, a free-wheeling element, and a switching element; and a processor portion being configured to implement a first current control during an implementation period, the implementation period including a first time interval and a second time interval, the implementation period being longer than a commercial power period, the first current control for transferring a control signal having a predetermined duty ratio to the switching element during the first time interval and transferring a control signal having a 100% duty ratio to the switching element during the second time interval, wherein:

the switching element is configured to deliver current to the heater while being driven at a switching frequency based on the control signal from the processor portion during the first time interval, the current having a switching period shorter than half the commercial power period, and to deliver current to the heater while not being driven during the second time interval; and the value of the predetermined duty ratio falls within a range causing no continuous current delivered to the heater.

2. The fuser control device according to claim 1, wherein:

the processor portion is further configured to implement a second current control for transferring a control signal having the predetermined duty ratio to the switching element; and the switching element is further configured to deliver current to the heater while being driven at the switching frequency determined by the control signal from the processor portion during the second current control.

3. The fuser control device according to claim 1, wherein the processor portion is further configured to judge whether to implement the first current control or implement the second current control with reference to a predetermined variable.

4. The fuser control device according to claim 3, further comprising a current detecting portion, the current detecting portion being configured to detect the value of current flowing into the reactor, as the predetermined variable, wherein the processor portion is further configured to implement the first current control if the detection result obtained by the current detecting portion is not 0 amperes.

5. The fuser control device according to claim 3, wherein the processor portion is further configured to determine a duty ratio for controlling the temperature of the heater, as the predetermined variable, and to implement the first current control if the determined duty ratio is higher than a threshold for judging whether or not continuous current is delivered to the heater.

6. The fuser control device according to claim 5, wherein the threshold is different depending on the value of a commercial power voltage.

7. The fuser control device according to claim 3, further comprising a temperature detecting portion, the temperature detecting portion being configured to detect the temperature of the switching element as the predetermined variable, wherein the processor portion is further configured to implement the first current control if the detection result obtained by the temperature detecting portion is higher than a threshold for judging whether or not continuous current is delivered to the heater.

8. The fuser control device according to claim 1, wherein the switching frequency is maintained over the upper limit of the audible frequency range.

9. The fuser control device according to claim 8, wherein the implementation period is preset to a multiple of twice the commercial power period.

10. The fuser control device according to claim 1, further comprising a voltage detecting portion, the voltage detecting portion being configured to detect the value of the commercial power voltage, wherein the processor portion is further configured to define the implementation period using the detection result obtained by the voltage detecting portion.

11. The fuser control device according to claim 1, wherein the processor portion is further configured to generate a signal having the predetermined duty ratio using pulse width modulation or pulse frequency modulation technique.

12. The fuser control device according to claim 1, wherein the heater is a halogen heater.

13. An image forming apparatus comprising the fuser control device according to claim 1.

14. The image forming apparatus according to claim 13, wherein the processor portion is further configured to implement the first current control both during a print operation and during a warm-up operation or either during a print operation or during a warm-up operation.

* * * * *